US009373920B2

(12) United States Patent
Miki et al.

(10) Patent No.: US 9,373,920 B2
(45) Date of Patent: Jun. 21, 2016

(54) CONNECTOR INCLUDING MODULE THAT INCLUDES MOLDED PART INSERT-MOLDED WITH CONTACTS EACH INCLUDING FIRST CONTACT PART, SECOND CONTACT PART, AND BODY THAT EXTENDS BETWEEN FIRST AND SECOND CONTACT PARTS AND INCLUDES SPRING PORTION GREATER IN WIDTH THAN FIRST AND SECOND CONTACT PARTS

(71) Applicants: FUJITSU COMPONENT LIMITED, Tokyo (JP); FUJITSU LIMITED, Kawasaki-shi, Kanagawa (JP)

(72) Inventors: Yasuyuki Miki, Tokyo (JP); Mitsuru Kobayashi, Tokyo (JP); Takahiro Kondo, Tokyo (JP); Takatoshi Yagisawa, Kawasaki (JP)

(73) Assignees: FUJITSU COMPONENT LIMITED, Tokyo (JP); FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/186,035

(22) Filed: Feb. 21, 2014

(65) Prior Publication Data

US 2014/0242845 A1 Aug. 28, 2014

(30) Foreign Application Priority Data

Feb. 22, 2013 (JP) ..... 2013-033613

(51) Int. Cl.
*H01R 24/00* (2011.01)
*H01R 24/66* (2011.01)
(Continued)

(52) U.S. Cl.
CPC ..... *H01R 24/66* (2013.01); *H01R 12/724* (2013.01); *H01R 12/737* (2013.01); *H01R 23/725* (2013.01); *H01R 12/7011* (2013.01); *H01R 12/721* (2013.01)

(58) Field of Classification Search
CPC .. H01R 23/70; H01R 23/725; H01R 23/7068; H01R 23/7078
USPC ..... 439/629–630
See application file for complete search history.

(56) References Cited

U.S. PATENT DOCUMENTS 4,975,086 A * 12/1990 Reichardt et al. ..... 439/629
5,074,039 A * 12/1991 Hillbish et al. ..... 29/883
(Continued)

FOREIGN PATENT DOCUMENTS

CN 2520021 11/2002
CN 2932686 8/2007
(Continued)

*Primary Examiner* — Chandrika Prasad
(74) *Attorney, Agent, or Firm* — IPUSA, PLLC

(57) ABSTRACT

A connector includes a module and a housing that accommodates the module. The module includes multiple contacts each including a first contact part to contact a board, a second contact part to contact a connection object, and a body extending at angle from the first contact part to the second contact part; and a molded part insert-molded with the contacts arranged as inserts. The molded part covers a portion of the body part through a surface of the first contact part of each of the contacts facing toward the board. In each contact, a width of the portion of the body covered with the molded part is smaller than a width of a spring portion of the body. The spring portion is exposed from the molded part and supports the second contact part in such a manner as to allow its displacement.

9 Claims, 8 Drawing Sheets

(51) Int. Cl.

| | |
|---|---|
| ***H01R 12/50*** | (2011.01) |
| ***H01R 12/73*** | (2011.01) |
| *H01R 12/70* | (2011.01) |
| *H01R 12/72* | (2011.01) |

(56) References Cited

U.S. PATENT DOCUMENTS

| | | | | |
|---|---|---|---|---|
| 6,315,621 | B1 * | 11/2001 | Natori et al. | 439/862 |
| 6,537,086 | B1 | 3/2003 | Mac Mullin | |
| 7,559,811 | B1 * | 7/2009 | Polnyi | 439/862 |
| 7,744,421 | B2 * | 6/2010 | Harada | H01R 12/57 439/630 |
| 8,070,498 | B2 * | 12/2011 | Shen | 439/66 |
| 8,123,542 | B2 | 2/2012 | Kimura et al. | |
| 8,330,046 | B2 * | 12/2012 | Riebel et al. | 174/126.4 |
| 2006/0035526 | A1 * | 2/2006 | Shimizu | H01R 23/68 439/660 |
| 2006/0216969 | A1 * | 9/2006 | Bright et al. | 439/79 |
| 2010/0330848 | A1 | 12/2010 | Kondo et al. | |
| 2012/0142200 | A1 | 6/2012 | Ito et al. | |
| 2013/0164990 | A1 * | 6/2013 | Tsai | 439/660 |
| 2013/0288536 | A1 * | 10/2013 | Lan et al. | 439/638 |

FOREIGN PATENT DOCUMENTS

| | | |
|---|---|---|
| JP | 103-033971 | 4/1991 |
| JP | 2010-015909 | 1/2010 |
| JP | 2011-009151 | 1/2011 |
| JP | 2011-154894 | 8/2011 |
| JP | 2012-195284 | 10/2012 |

* cited by examiner

CONNECTOR INCLUDING MODULE THAT INCLUDES MOLDED PART INSERT-MOLDED WITH CONTACTS EACH INCLUDING FIRST CONTACT PART, SECOND CONTACT PART, AND BODY THAT EXTENDS BETWEEN FIRST AND SECOND CONTACT PARTS AND INCLUDES SPRING PORTION GREATER IN WIDTH THAN FIRST AND SECOND CONTACT PARTS

CROSS-REFERENCE TO RELATED APPLICATION

The present application is based upon and claims the benefit of priority of Japanese Patent Application No. 2013-033613, filed on Feb. 22, 2013, the entire contents of which are incorporated herein by reference.

BACKGROUND OF THE INVENTION

1. Field of the Invention

The present invention relates to connectors.

2. Description of the Related Art

So-called card edge connectors are used to connect boards, for example, to connect a graphic card to a motherboard in personal computers (PCs) and printers.

As a known configuration of such connectors, multiple contacts that connect an object to be connected (hereinafter, "a connection object") and a board are provided, and are fixed to and held in a housing into which the connection object is to be inserted by being press-fitted into the housing. (See, for example, Japanese Patent Application No. 2010-15909.)

SUMMARY OF THE INVENTION

According to an aspect of the present invention, a connector includes a module and a housing that accommodates the module. The module includes multiple contacts each including a first contact part to contact a board, a second contact part to contact a connection object, and a body extending at angle from the first contact part to the second contact part; and a molded part insert-molded with the contacts arranged as inserts. The molded part covers a portion of the body part through a surface of the first contact part of each of the contacts facing toward the board. In each contact, a width of the portion of the body covered with the molded part is smaller than a width of a spring portion of the body. The spring portion is exposed from the molded part and supports the second contact part in such a manner as to allow its displacement.

DESCRIPTION OF THE EMBODIMENTS

Figure 1:
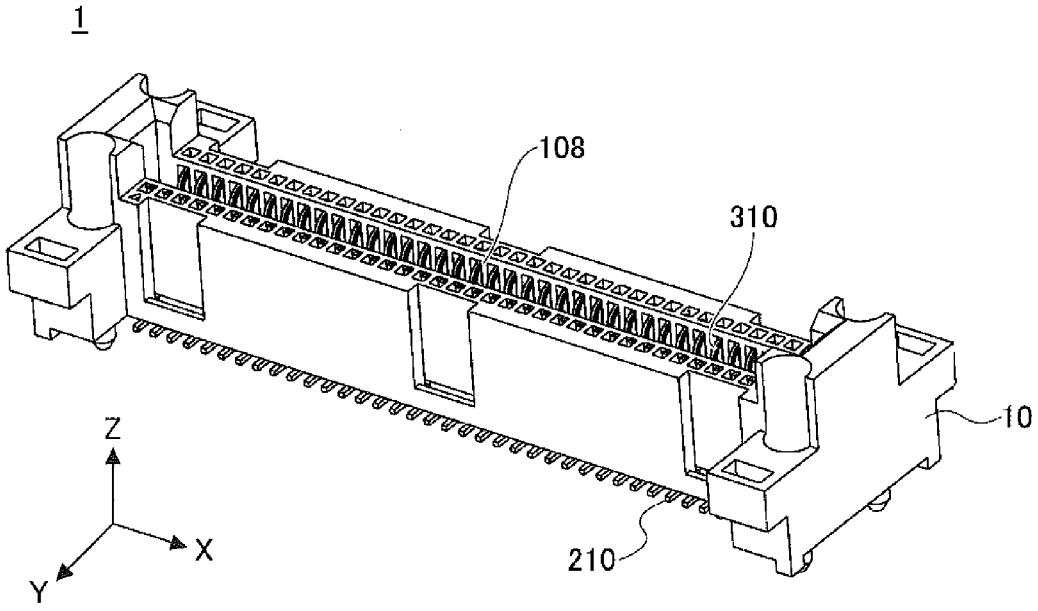
FIG. 1 is a perspective view of a connector according to a first embodiment.

Embodiments of the present invention are described below with reference to the accompanying drawings. In the drawings, the same elements are referred to by the same reference numerals, and their description may not be repeated.

First Embodiment

FIG. 1 is a perspective view of a connector 1 according to a first embodiment. In the drawings, an X direction, a Y direction and a Z direction indicate a lengthwise direction, a widthwise direction and a height direction, respectively, of the connector 1.

Referring to FIG. 1, the connector 1 includes a housing 10, first contacts 210, and second contacts 310.

The housing 10 is formed of, for example, insulating resin. A lower surface of the housing 10 in FIG. 1 is fixed to a board. The housing 10 includes an insertion slot 108 into which a connection object such as a board to be connected is inserted substantially parallel to the Z direction. Both the first contacts 210 and the second contacts 310 are arranged at regular intervals in the X direction in the housing 10. The first contacts 210 and the second contacts 310 may not be arranged at regular intervals.

The first contact 210 and the second contact 310 are formed by bending a leaf spring member made of a conductive metal material, for example. Each of the first contacts 210 and the second contacts 310 includes a contact point part and a contact part and connects the connection object and the board. The contact point part is exposed to the insertion slot 108 of the housing 10 and comes into contact with the connection object. The contact part is exposed on the lower side of the housing 10 and comes into contact with the board.

Figure 2:
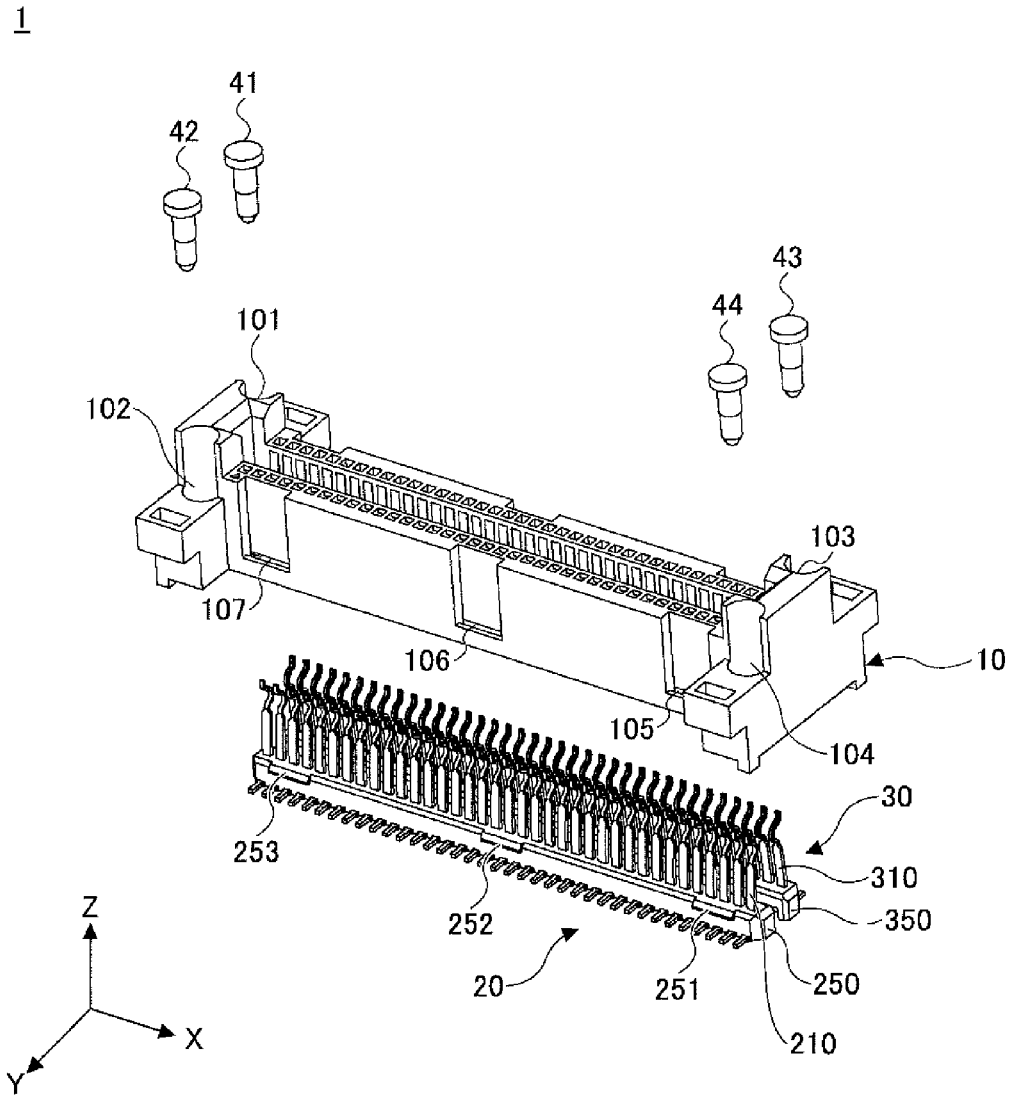
FIG. 2 is an exploded perspective view of the connector according to the first embodiment.

FIG. 2 is an exploded perspective view of the connector 1 according to the first embodiment.

Referring to FIG. 2, the connector 1 includes the housing 10, a first module 20, a second module 30, and fixing pins 41, 42, 43 and 44.

The housing 10 accommodates the first module 20 and the second module 30. The fixing pins 41, 42, 43 and 44 are inserted into fixing holes 101, 102, 103 and 104 of the housing 10, respectively, so that the housing 10 is fixed to the board.

The first module 20 includes the first contacts 210 and a first molded part 250. The first module 20 is manufactured by insert-molding the first molded part 250 with the first contacts 210 arranged in the first molded part 250 as inserts. The second module 30 includes the second contacts 310 and a second molded part 350, and has the same configuration as the first module 20.

The first module 20 and the second module 30 are accommodated in the housing 10 so that contact point parts of the first contacts 210 that come into contact with the connection object and contact point parts of the second contacts 310 that come into contact with the connection object face each other in the Y direction.

The first molded part 250 of the first module 20 includes multiple projecting parts 251, 252 and 253 at different positions in the X direction. Furthermore, the housing 10 includes openings 105, 106 and 107 at positions corresponding to the projecting parts 251, 252 and 253 of the first molded part 250, respectively. The first module 20 is inserted into the housing 10 from the lower side in FIG. 2 to have the projecting parts 251, 252 and 253 of the first molded part 250 engaging with the openings 105, 106 and 107 of the housing 10, respectively, so that the first module 20 is fixed to the housing 10.

Likewise, the second molded part 350 of the second module 30 includes multiple projecting parts (not illustrated in FIG. 2) at different positions in the X direction, and the projecting parts engage with openings (not illustrated in FIG. 2) provided at positions corresponding to the projecting parts in the housing 10, so that the second module 30 is fixed to the housing 10.

Because the first module 20 and the second module 30 have the same configuration, the first module 20, the first contacts 210, and the first molded part 250 are mainly described in the following description. Furthermore, because each of the first contacts 210 has the same configuration, the first contacts 210 may be collectively referred to as "first contact 210" when describing the configuration in the following description.

Figure 3B:
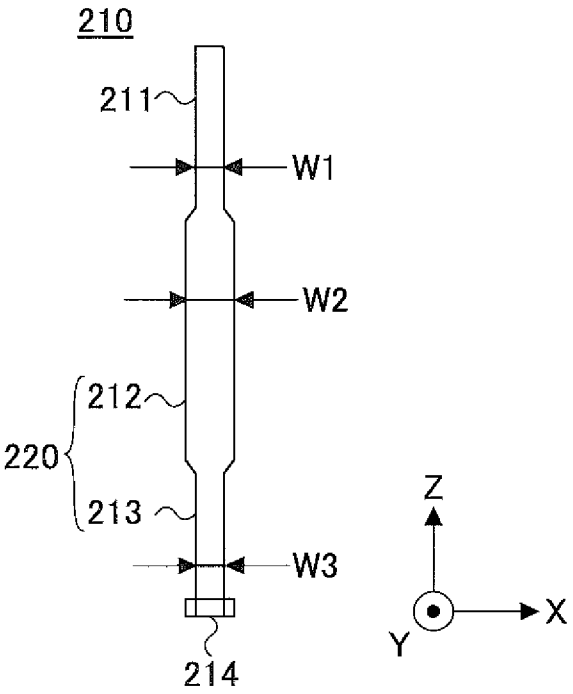
FIGS. 3A and 3B are a perspective view and a front view, respectively, of a first contact according to the first embodiment.
Figure 3A:
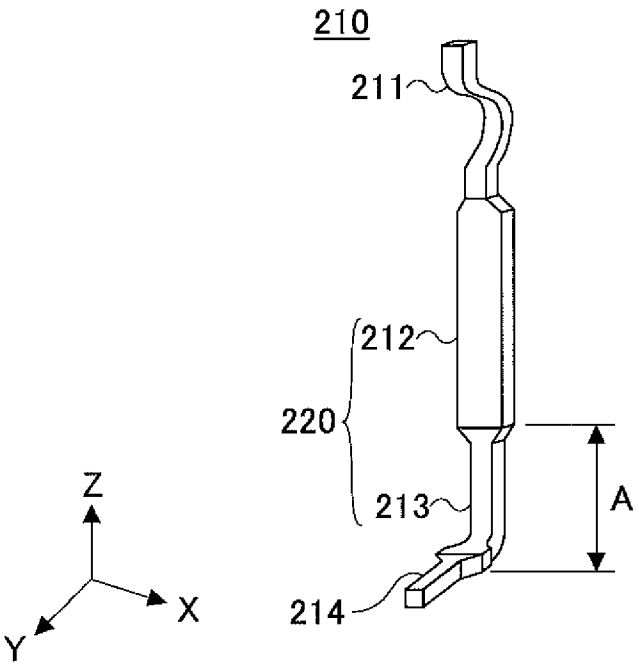

FIGS. 3A and 3B are a perspective view and a front view, respectively, of the first contact 210 according to the first embodiment.

Referring to FIG. 3A, the first contact 210 includes a contact point part 211, a contact part 214, and a body part 220. The contact point part 211 comes into contact with the connection object inserted into the housing 10. The contact part 214 comes into contact with the board. The body part 220 extends at an angle from the contact part 214 to the contact point part 211.

The contact point part 211 is bent so as to project toward the side opposite to the side on which the contact part 214 extends (that is, in a direction opposite to the Y direction in FIGS. 3A and 3B). With the first module 20 being accommodated in the housing 10, the bent portion of the contact point part 211 is exposed to the insertion slot 108 of the housing 10 and the backside (the side opposite the side illustrated in FIG. 3B, that is, the projecting side) of the bent portion in FIG. 3A comes into contact with the connection object.

The contact part 214 extends in a direction substantially parallel to a surface of a board on which the connector 1 is to be mounted, and a lower surface of the contact part 214 in FIG. 3A comes into contact with a terminal on the board.

The body part 220 is formed by bending a portion extending from the contact part 214 so as to extend in a direction substantially perpendicular to the contact part 214 and the surface of the board on which the connector 1 is to be connected (that is, in a direction substantially parallel to the Z direction). The body part 220 includes a covered portion 213 (a region A indicated by a double-headed arrow in FIG. 3A) extending between a portion of the body part 220 and the surface of the contact part 214 that comes into contact with the board. The covered portion 213 is covered with the first molded part 250 by insert molding.

The body part 220 includes a spring portion 212, which is not covered with the first molded part 250. The spring portion 212 elastically deforms when the contact point part 211 comes into contact with the connection object, so as to support the contact point part 211 so that the contact point part 211 may be displaced in the Y direction.

Referring to FIG. 3B, a width W1 of the contact point part 211 in a direction in which the first contacts 210 are arranged (X direction) is smaller than a width W2 of the spring portion 212. Furthermore, the covered portion 213 is formed so that at least part of the covered portion 213 has a width W3 that is smaller than the width W2 of the spring portion 212.

The first contacts 210 are arranged so that a signal line (S) and a ground line (G) are adjacent to each other (for example, in a manner such as GSGSG . . . or GSSG . . . ), and the impedance is determined by the interval between adjacent contacts, the contact width, and the contact relative permittivity. The width W2 of the spring portion 212 and the width W3 of the covered portion 213 to be covered with the first molded part 250 of the first contact 210 are so determined in accordance with a material used for the first molded part 250 and the interval between adjacent contacts as to control impedance.

The first module 20 is manufactured by insert-molding the first molded part 250 with the first contacts 210 as inserts, so that the first contacts 210 are fixed to and held by the first molded part 250. Therefore, portions of the first contacts 210 such as a projecting part and a bent part do not require complicated shapes for fixation to a housing and/or a molded part, and it is possible to control the impedance of the first contacts 210 by adjusting the width W3 of the covered portion 213 of each of the first contacts 210.

Furthermore, the first molded part 250 covers a portion of the body part 220 through a board-side lower surface of the contact part 214 of each of the first contacts 210. As a result, no portion between the contact part 214 and the covered portion 213 is exposed to an air layer in each of the first contacts 210. Accordingly, it is possible to control impedance with high accuracy.

Figure 4:
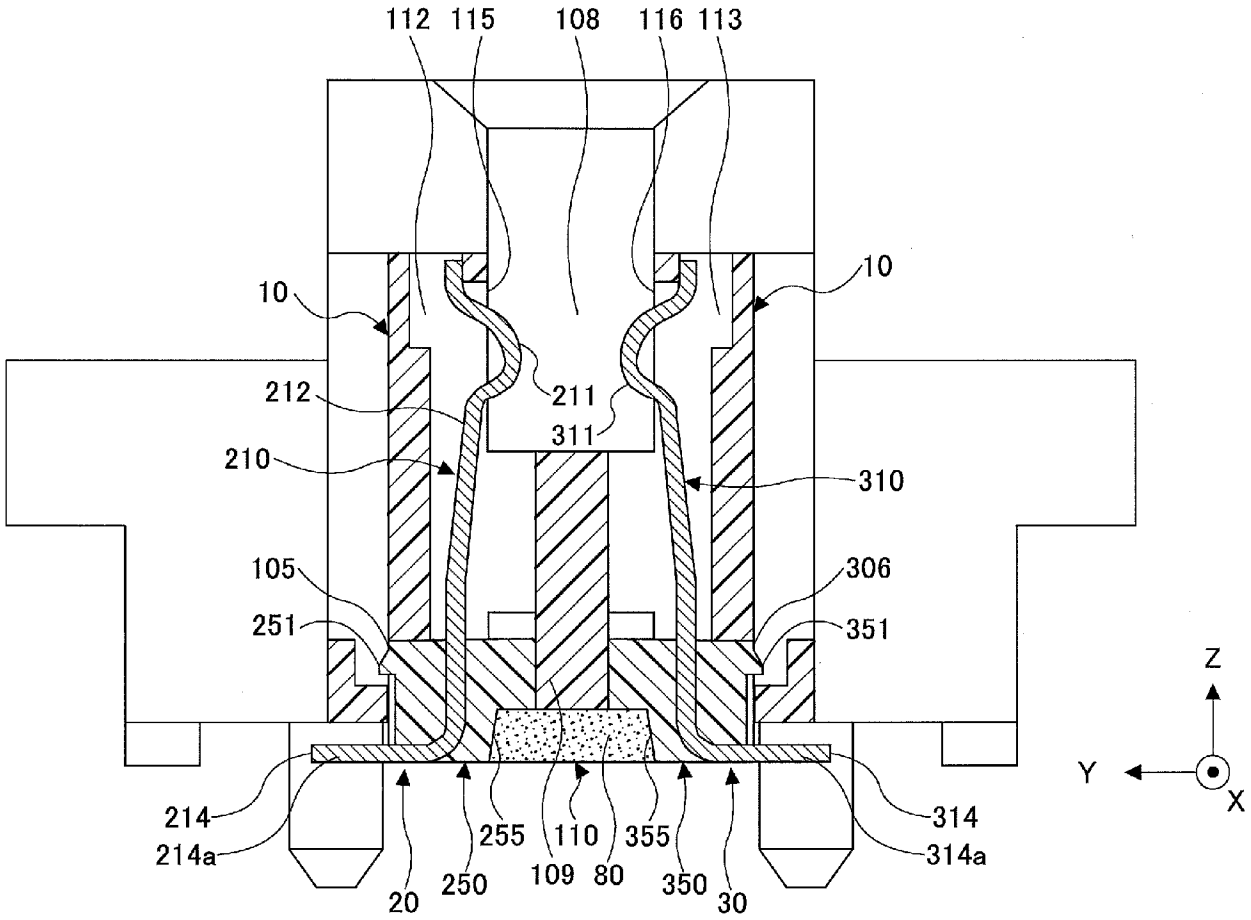
FIG. 4 is a cross-sectional view of the connector according to the first embodiment.

FIG. 4 is a cross-sectional view of the connector 1 according to the first embodiment, taken along a Y-Z plane passing through one of the first contacts 210 and one of the second contacts 310 which ones are opposed to each other.

Referring to FIG. 4, the connector 1 includes the housing 10 and the first and second modules 20 and 30 opposed to each other, and connects a connection object inserted through the insertion slot 108 and a board.

The housing 10 includes a first module hole 112 into which the first module 20 is inserted and a second module hole 113 into which the second module 30 is inserted. The first module hole 112 and the second module hole 113 are separated by a partition wall 109.

The first module hole 112 includes the opening 105 that engages with the projecting part 251 of the first molded part 250. The first module 20 is inserted into the first module hole 112 of the housing 10 and the projecting part 251 of the first molded part 250 engages with the opening 105, so that the first module 20 is fixed to the housing 10.

Likewise, the second module hole 113 includes an opening 306 that engages with a projecting part 351 of the second molded part 350. The projecting part 351 of the second molded part 350 engages with the opening 306, so that the second module 30 is fixed to the housing 10.

The first molded part 250 of the first module 20 includes a cut part 255 and the second molded part 350 of the second module 30 includes a cut part 355. With the first module 20 and the second module 30 being inserted in the housing 10, the cut parts 255 and 355, together with the partition wall 109 of the housing 10, form a groove part 110. Adhesive 80 is applied to the groove part 110, and the first module 20 and the second module 30 are fixed to the housing 10 with the adhesive 80 applied to the groove part 110.

The first module hole 112 includes first contact point openings 115 through which the contact point parts 211 of the first contacts 210 project into the insertion slot 10B. With the first module 20 being fixed to the housing 10, each of the contact point parts 211 of the first contacts 210 projects into the insertion slot 108 through the corresponding first contact point opening 115 to come into contact with the connection object inserted into the insertion slot 108. When the contact point part 211 comes into contact with the connection object, the contact point part 211 is displaced in a direction to move away from the second contact 310, and the spring portion 210 elastically deforms to support the corresponding contact point part 211 and presses the corresponding contact point part 211 against the connection object.

Likewise, the second module hole 113 includes second contact point openings 116, and respective contact point parts 311 of the second contacts 310 project into the insertion slot 108 through the corresponding second contact point openings 116. The contact point parts 211 of the first contacts 210 and the contact point parts 311 of the second contacts 310 are opposed to each other in the insertion slot 108. The contact point parts 211 of the first contacts 210 and the contact point parts 311 of the second contacts 310 come into contact with first and second opposite surfaces of the connection object inserted into the insertion slot 108, respectively.

The contact parts 214 of the first contacts 210, which project from the first molded part 250 in a direction away from the partition wall 109 (that is, in the Y direction in FIG. 4), are exposed downward from the housing 10, and have respective lower surfaces 214*a* come into contact with corresponding terminals on the board on which the connector 1 is to be mounted. Likewise, contact parts 314 of the second contacts 310, which project from the second molded part 350 in a direction away from the partition wall 109 (that is, in a direction opposite to the Y direction in FIG. 4), are exposed downward from the housing 10, and have respective lower surfaces 314*a* come into contact with corresponding terminals on the board on which the connector 1 is to be mounted.

By the above-described configuration, the first module 20 and the second module 30 are fixed to the housing 10. Furthermore, the first contacts 210 and the second contacts 310 connect the connection object inserted into the insertion slot 108 and the board.

Figure 5:
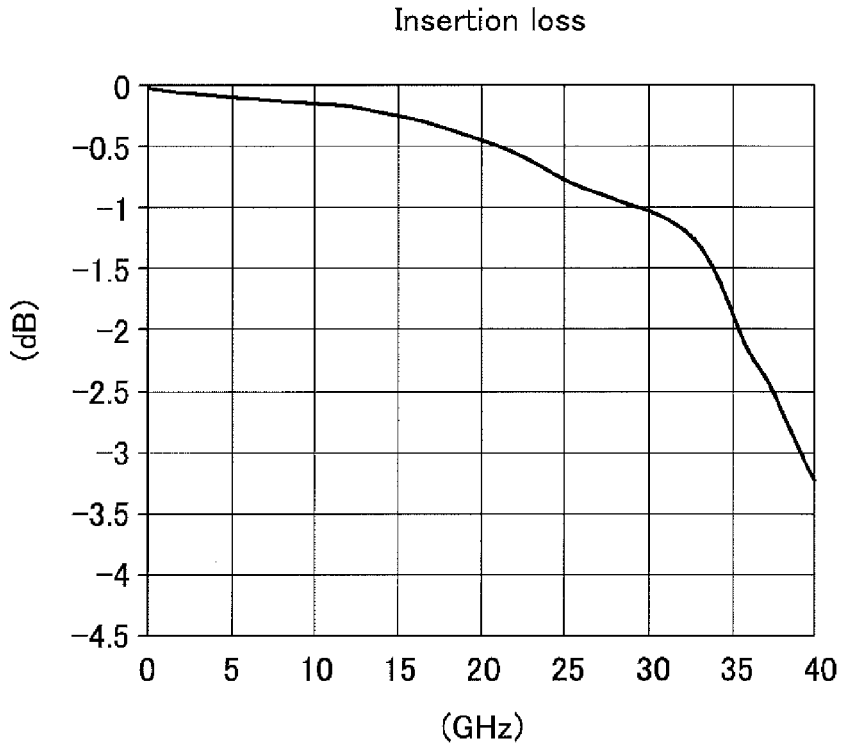
FIG. 5 is a graph illustrating the result of a simulation of a transmission characteristic of the connector according to the first embodiment.

FIG. 5 is a graph illustrating the result of a simulation of a transmission characteristic of the connector 1 according to the first embodiment. FIG. 5 illustrates a transmission characteristic of the connector 1, indicating that the connector 1 has a good transmission characteristic up to a high frequency range without the occurrence of large attenuation.

Figure 6:
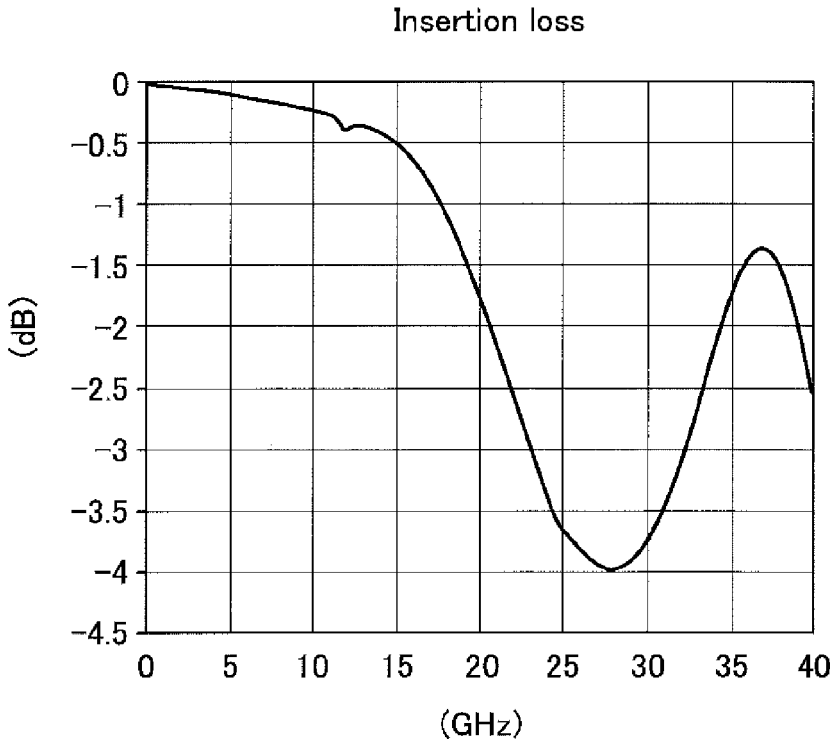
FIG. 6 is a graph illustrating the result of a simulation of a transmission characteristic of a connector.

On the other hand, FIG. 6 is a graph illustrating the result of a simulation of a transmission characteristic of a connector that is not according to this embodiment. FIG. 6 indicates that attenuation increases in a high frequency range and thus it may not be possible to support high-speed transmission.

As described above, the first contacts 210 of the connector 1 are subjected to insert molding so that part of each of the first contacts 210 between a portion of the body part 220 and the contact surface 214*a* of the contact part 214 that comes into contact with a board to which the housing 10 is fixed is covered with the first molded part 250. Furthermore, each of the first contacts 210 is formed so that at least part of the covered portion 213 covered with the first molded part 250 has the width W3 smaller than the width W2 of the spring portion 212.

The first connector 1 according to the first embodiment includes the first contacts 210 and the second contacts 310 which have the same shape as the first contacts 210, and the impedance is determined by, for example, adjusting the width of the covered portion of each contact. Therefore, the transmission characteristics of the connector 1 are improved because of impedance matching, so that the connector 1 is capable of supporting high-speed transmission.

Second Embodiment

Next, a second embodiment is described based on FIGS. 7A and 7B, FIG. 8 and FIG. 9.

Figure 7A:
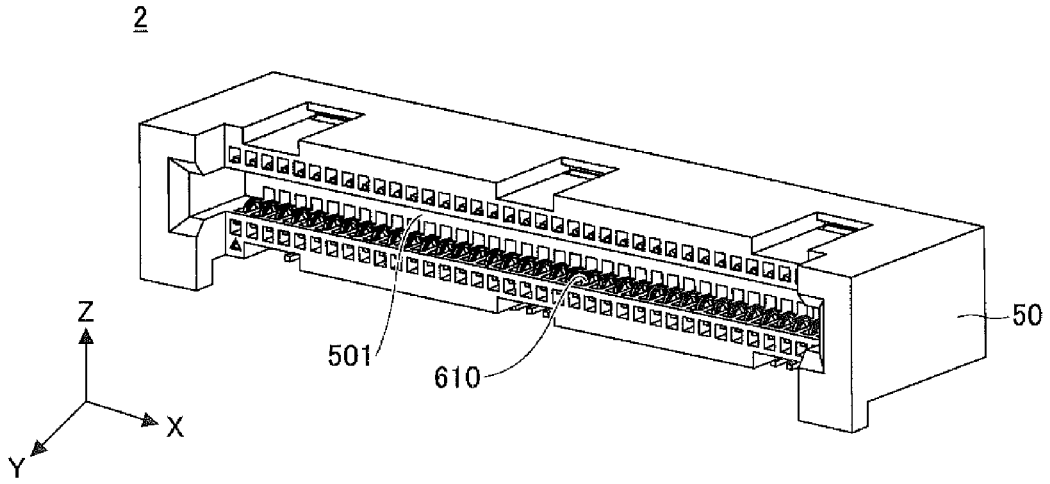
FIGS. 7A and 7B are perspective views of a connector according to a second embodiment.
Figure 7B:
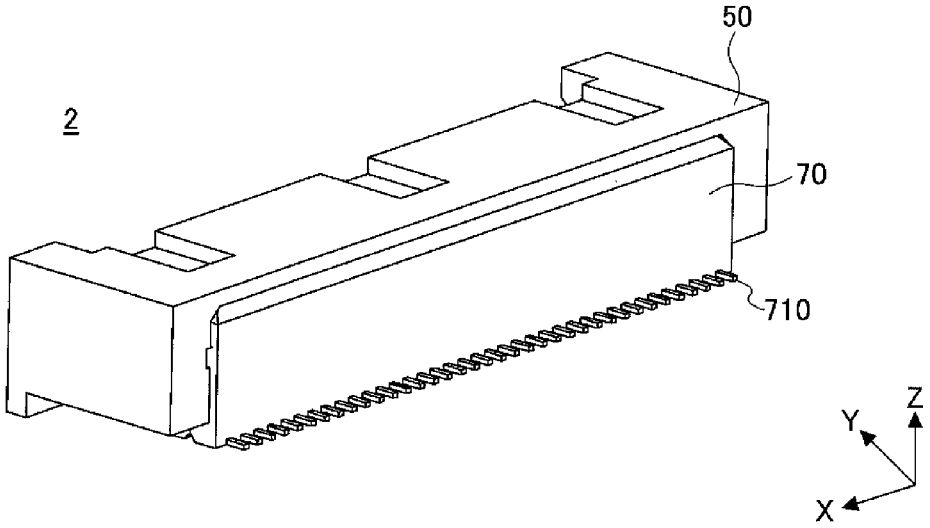

FIGS. 7A and 7B are a front-side perspective view and a back-side perspective view of a connector 2 according to the second embodiment, respectively.

Referring to FIGS. 7A and 7B, the connector 2 includes a housing 50, whose lower surface in FIGS. 7A and 7B is to be fixed to a board. The housing 50 includes an insertion slot 501 into which a connection object such as a board to be connected is inserted substantially parallel to the Y direction.

Figure 8:
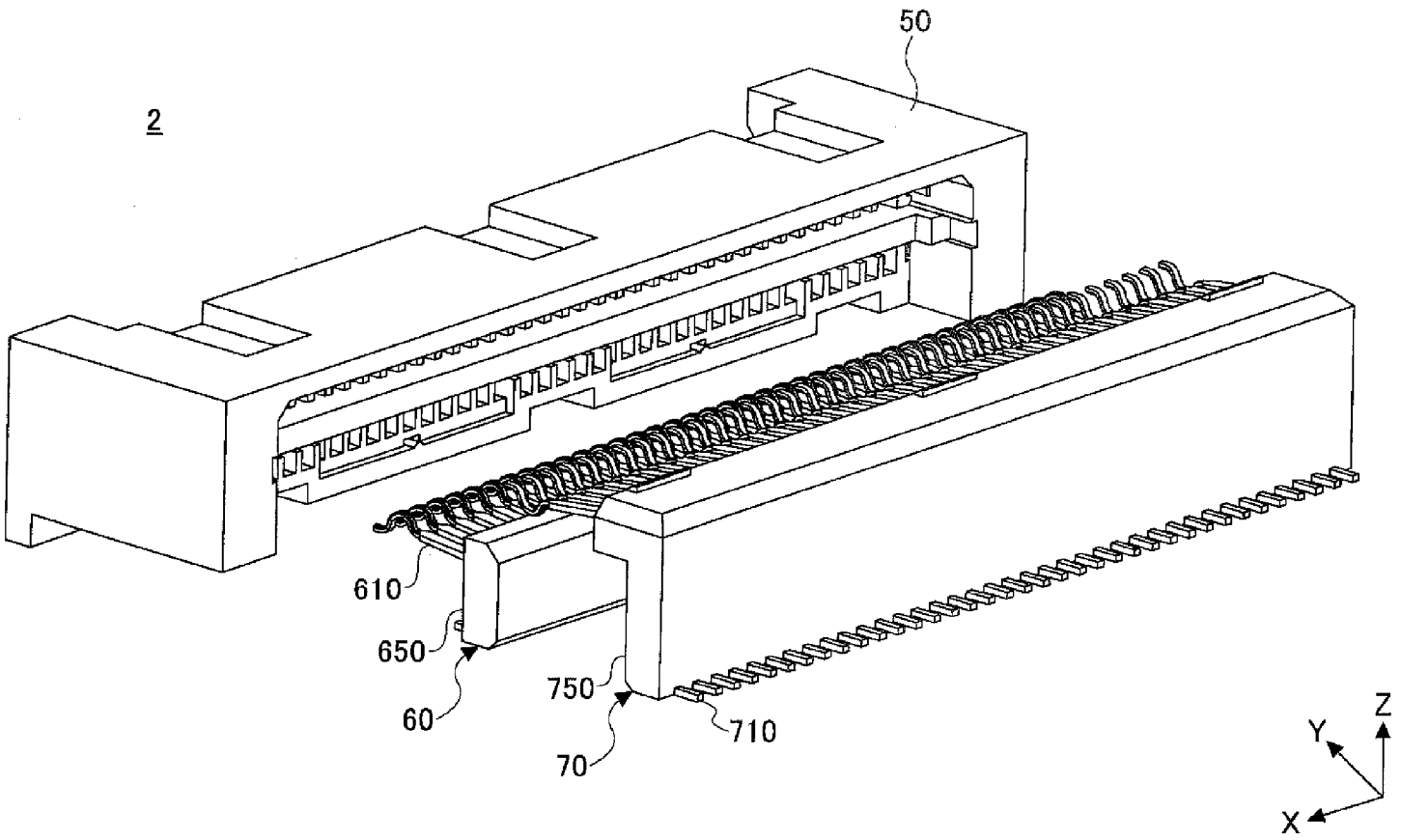
FIG. 8 is an exploded perspective view of the connector according to the second embodiment.

FIG. 8 is an exploded perspective view of the connector 2 according to the second embodiment.

Referring also to FIG. 8, the housing 50, which is formed of, for example, insulating resin, accommodates a first module 60 including multiple first contacts 610 and a second module 70 including multiple second contacts 710. The first contacts 610 and the second contacts 710 are formed by bending a leaf spring member made of a conductive metal material, for example, and connect the connection object and the board.

Referring to FIG. 8, the connector 2 includes the first module 60, the second module 70, and the housing 50 that accommodates the first module 60 and the second module 70.

The first module 60 is manufactured by insert-molding a first molded part 650 with the first contacts 610 as inserts. Likewise, the second module 70 is manufactured by insert-molding a second molded part 750 with the second contacts 710 as inserts.

The first module 60 and the second module 70 are accommodated in the housing 50 so that contact point parts of the first contacts 610 that come into contact with the connection object and contact point parts of the second contacts 710 that come into contact with the connection object face each other.

Figure 9:
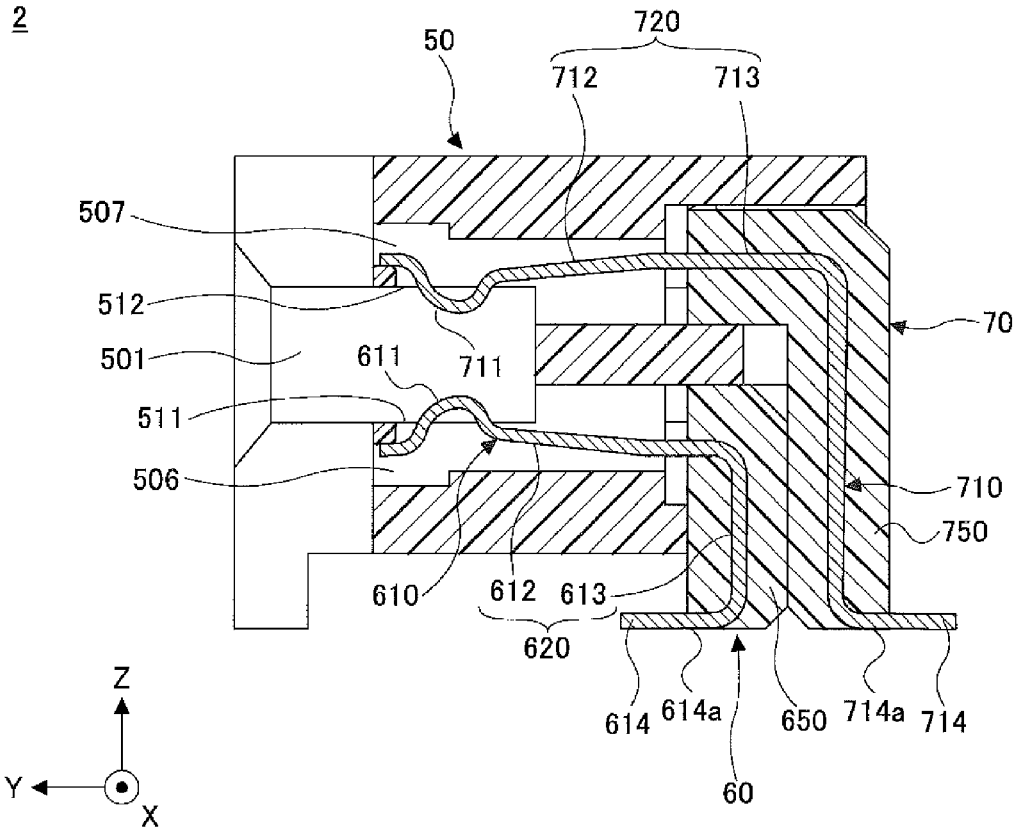
FIG. 9 is a cross-sectional view of the connector according to the second embodiment.

FIG. 9 is a cross-sectional view of the connector 2 according to the second embodiment, taken along a Y-Z plane passing through one of the first contacts 610 and one of the second contacts 710 which ones are opposed to each other.

The housing 50 includes the insertion slot 501 into which a connection object is inserted, a first module hole 506 into which the first module 60 is inserted, and a second module hole 507 into which the second module 70 is inserted.

The connection object is inserted into the insertion hole 501 in a direction substantially parallel to the Y direction. The first module 60 is inserted into the first module hole 506 from the side opposite to the insertion slot 501 in the Y direction. Furthermore, the second module 70 is inserted into the second module hole 507 from the side opposite to the insertion slot 501 in the Y direction.

Each of the first contacts 610 of the first module 60 includes a contact point part 611, a contact part 614, and a body part 620. The contact point part 611 comes into contact with the connection object inserted into the housing 50. The contact part 614 comes into contact with the board. The body part 620 continues from the contact part 614 to the contact point part 611. The body part 620 extends at an angle to the contact part 614.

The contact point part 611 is bent so as to project upward in FIG. 9. The bent portion of the contact point part 611 is exposed to the insertion slot 501 through a corresponding one of first contact point openings 511 of the housing 50, so as to come into contact with a lower surface of the connection object inserted into the insertion slot 501.

The contact part 614 is exposed from the housing 50 toward the board on which the connector 2 is to be mounted. The contact part 614 includes a lower surface 614*a* that comes into contact with a terminal on the board.

The body part 620 extends at an angle from the contact part 614 in a direction substantially parallel to the Z direction to the contact point part 611. Part of each of the first contacts 610 between a portion of the body part 620 and the lower surface 614*a* of the contact part 614 is covered with the first molded part 650.

The body part 620 includes a spring portion 612. The spring portion 612 elastically deforms when the contact point part 611 comes into contact with the connection object, so as to support the contact point part 611 so that the contact point part 611 may be displaced. When the connection object is inserted into the insertion slot 501, the contact point part 611 is displaced downward in FIG. 9, and the spring portion 612 elastically deforms to support the contact point part 611 and press the contact point part 611 against the connection object. The body part 620 further includes a covered portion 613 covered with the first molded part 650. The covered portion 613 is bent so that the spring part 612 extends in a direction substantially parallel to a surface of the board (a direction substantially parallel to the Y direction).

In each of the first contacts 610, a width of the contact point part 611 in an arrangement direction in which the first contacts 610 are arranged (that is, the X direction) is smaller than a width of the spring portion 612. Furthermore, a width of at least part of the covered portion 613 in the arrangement direction is smaller than the width of the spring portion 612.

Each of the second contacts 710 of the first module 70 includes a contact point part 711, a contact part 714, and a body part 720. The contact point part 711 comes into contact with the connection object inserted into the housing 50. The contact part 714 comes into contact with the board. The body part 720 continues from the contact part 714 to the contact point part 711. The body part 620 extends at an angle to the contact part 714.

The contact point part 711 is bent so as to project downward in FIG. 9. The bent portion of the contact point part 711 is exposed to the insertion slot 501 through a corresponding one of second contact point openings 512 of the housing 50, so as to come into contact with an upper surface of the connection object inserted into the insertion slot 501.

The contact part 714 is exposed from the housing 50 toward the board to which the connector 2 is to be fixed. The contact part 714 includes a lower surface 714*a* that comes into contact with a terminal on the board.

The body part 720 extends at an angle from the contact part 714 in a direction substantially parallel to the Z direction to continue to the contact point part 711. Part of each of the first contacts 710 between a portion of the body part 720 and the lower surface 714*a* of the contact part 714 is covered with the second molded part 750.

The body part 720 includes a spring portion 712. The spring portion 712 elastically deforms when the contact point part 711 comes into contact with the connection object, so as to support the contact point part 711 so that the contact point part 711 may be displaced. When the connection object is inserted into the insertion slot 501, the contact point part 711 is displaced upward in FIG. 9, and the spring portion 712 elastically deforms to support the contact point part 711 and press the contact point part 711 against the connection object. The body part 720 further includes a covered portion 713 covered with the second molded part 750. The covered portion 713 is bent so that the spring part 712 extends in a direction substantially parallel to a surface of the board (a direction substantially parallel to the Y direction).

In each of the second contacts 710, a width of the contact point part 711 in an arrangement direction in which the second contacts 710 are arranged (that is, the X direction) is smaller than a width of the spring portion 712. Furthermore, a width of at least part of the covered portion 713 in the arrangement direction is smaller than the width of the spring portion 712.

The connector 2 according to the second embodiment has the above-described configuration, and it is possible to achieve impedance matching by, for example, suitably adjusting the widths of the respective covered portions 613 and 713 of the first contacts 610 and the second contacts 710. Accordingly, like the connector 1 according to the first embodiment, the connector 2 according to the second embodiment has good transmission characteristics up to a high frequency range without the occurrence of large attenuation in a transmission characteristic and is capable of supporting high-speed transmission.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A connector, comprising:

a module that connects a board and a connection object; and a housing that accommodates the module, wherein the module includes a plurality of contacts each including a first contact part that comes into contact with the board, a second contact part that comes into contact with the connection object, and a body extending at angle from the first contact part to the second contact part; and a molded part insert-molded with the contacts arranged as inserts, wherein the molded part covers a portion of the body through a surface of the first contact part of each of the contacts, the surface facing toward the board, and in each of the contacts, a width of the portion of the body covered with the molded part is smaller than a width of a spring portion of the body, the spring portion being exposed and extending from the molded part and supporting the second contact part in such a manner as to allow a displacement thereof, and a width of the second contact part is smaller than the width of the spring portion, and wherein the first contact part includes a flat portion, the flat portion coming into contact with the board and extending directly from the portion of the body covered with the molded part and substantially parallel to the board.

2. The connector as claimed in claim 1, wherein the module includes a first module and a second module in each of which the contacts are provided, and the housing accommodates the first module and the second module so that the second contact parts of the contacts of the first module and the second contact parts of the contacts of the second module are opposed to each other.

3. The connector as claimed in claim 1, wherein the housing is configured to be fixed to the board with fixing pins.

4. The connector as claimed in claim 1, wherein the molded part includes a projecting part that engages with an opening in the housing, and the module is fixed to the housing by the projecting part engaging with the opening.

5. The connector as claimed in claim 2, wherein the molded part of the first module includes a first cut part and the molded part of the second module includes a second cut part, a surface of the first cut part, a surface of the second cut part, and a surface of a partition wall between the first module and the second module define a groove that is depressed relative to a surface of each of the molded parts facing toward the board, and the first module and the second module are accommodated in the housing and fixed to the housing with adhesive applied to the groove.

6. The connector as claimed in claim 1, wherein the body is bent and the spring part extends in a direction substantially parallel to a surface of the board, and the housing includes an insertion slot into which the connection object is inserted in a direction substantially parallel to the surface of the board.

7. The connector as claimed in claim 1, wherein the contacts are arranged so that a signal line and a ground line are adjacent to each other.

8. The connector as claimed in claim 1, wherein the portion of the body covered with the molded part is bent at a plurality of points so that the spring part extends from the portion of the body in a first direction substantially parallel to a surface of the board with which the flat portion of the first contact comes into contact and the first contact part extends from the portion of the body in a second direction opposite to the first direction.

9. The connector as claimed in claim 2, wherein the first contact and the spring portion of each of the contacts provided in the first module are exposed from a same surface of the first module, and the second module has a bent shape, and the first contact and the spring portion of each of the contacts provided in the second module are exposed from opposite surfaces of the second module.

* * * * *